US006083078A

United States Patent [19]

Yang

[11] Patent Number: 6,083,078

[45] Date of Patent: Jul. 4, 2000

[54] TOY WITH MOVING BODY MOVABLE BETWEEN TWO PLATFORMS

[75] Inventor: Chieh-Te Yang, Tainan, Taiwan

[73] Assignee: Dah Yang Toy Industrial Col, Ltd., Tainan, Taiwan

[21] Appl. No.: 09/233,978

[22] Filed: Jan. 20, 1999

[51] Int. Cl.[7] ..... A63H 18/14; A63H 17/40; A63H 27/00

[52] U.S. Cl. ..... 446/445; 446/7; 446/230; 446/441; 446/489

[58] Field of Search ..... 446/7, 230, 280, 446/423, 424, 441, 444, 445, 489

[56] References Cited

U.S. PATENT DOCUMENTS 3,616,306 10/1971 Arai .

*Primary Examiner*—Robert A. Hafer
*Assistant Examiner*—Laura Fossum
*Attorney, Agent, or Firm*—Vedder Price Kaufman & Kammholz

[57] ABSTRACT

A toy includes a first platform with a proximate edge, a distal edge, and first and second lateral edges interconnecting the proximate and distal edges. A moving body has a front wheel, first and second rear wheels, and a turning wheel between the front and rear wheels. The moving body is provided with a driving unit coupled to the turning wheel and the first rear wheel. The turning wheel is rotatable about an axis perpendicular to that of the front and rear wheels, and is disposed higher than bottom portions of the front and rear wheels to prevent the moving body from falling off the first platform when the driving unit drives movement of the moving body on the first platform. A connecting rail has a first end portion mounted on the proximate edge, and is connected to a second platform. A guiding unit is mounted on the first platform, and is selectively operable to cause the moving body to turn in a direction toward the connecting rail when the moving body is driven to move on the first platform so as to guide movement of the moving body onto the connecting rail.

14 Claims, 8 Drawing Sheets

TOY WITH MOVING BODY MOVABLE BETWEEN TWO PLATFORMS

BACKGROUND OF THE INVENTION

1. Field of the Invention

This invention relates to a toy with a moving body that is movable between two platforms, more particularly to a toy which is provided with a guiding unit that is selectively operable to guide a moving body to move from one platform to another platform.

2. Description of the Related Art

FIG. 1 illustrates a conventional toy that includes a moving body 102 movable on a platform 10. The moving body 102 is provided with a pair of front wheels 103 which are rotatable about a first rotary axis, a pair of rear wheels 104 which are rotatable about a second rotary axis parallel to the first rotary axis, and a turning wheel 105 on a bottom side of the moving body 102 between the front and rear wheels 103, 104 and rotatable about a third rotary axis perpendicular to the first and second rotary axes. When the moving body 102 is disposed on the platform 10, the bottom portion of the turning wheel 105 is disposed higher than bottom portions of the front and rear wheels 103, 104 such that the turning wheel 105 is normally not in contact with the platform 10. The moving body 102 is provided with a driving unit (not shown) which is coupled to the turning wheel 105 and one of the rear wheels 104 to drive forward movement of the moving body 102. When the moving body 102 is driven by the driving unit to move on the top side of the platform 10 and reach a boundary of the platform 10 such that the front wheels 103 move out of the platform 10, the moving body 102 inclines forwardly and downwardly such that the turning wheel 105 contacts the platform 10 to enable the moving body 102 to turn away from the boundary so as to prevent the moving body 102 from falling off the platform 10. Subsequently, when the driving unit continues to drive the moving body 102 to move on the top side of the platform 10 and reach another boundary of the platform 10, the turning wheel 105 acts once again to turn the moving body 102. In this manner, the moving body 102 can be maintained on the platform 10 without falling off the same. However, after being popular for years, this type of toy has become somewhat monotonous and has lost its consumer appeal.

SUMMARY OF THE INVENTION

Therefore, the object of the present invention is to provide a toy with a moving body which is movable between two platforms, at least one of which is provided with a guiding unit that is selectively operable to guide the moving body to move from said one of the platforms to the other one of the platforms. Accordingly, the toy of the present invention includes a hollow first platform, a moving body, a second platform, a connecting rail, and a guiding unit. The first platform has a top side, a proximate edge, a distal edge, and first and second lateral edges interconnecting the proximate and distal edges. The moving body has a front end portion provided with a front wheel unit which is rotatable about a horizontal first rotary axis, a rear end portion provided with a horizontal transmission shaft parallel to the first rotary axis, and a bottom side provided with a turning wheel between the front and rear end portions. The moving body further has a first rear wheel mounted securely on one end of the transmission shaft, and a second rear wheel mounted rotatably on another end of the transmission shaft. The turning wheel is rotatable about a horizontal second rotary axis perpendicular to the first rotary axis, and has a bottom portion which is disposed higher than bottom portions of the front wheel unit and the rear wheels. The moving body is provided with a driving unit that is coupled to the turning wheel and the transmission shaft to drive movement of the moving body on the top side of the first platform. The turning wheel prevents the moving body from falling off the first platform when the driving unit drives movement of the moving body on the top side of the first platform. The second platform is spaced apart from the first platform, and has a top side. The connecting rail has a first end portion mounted on the proximate edge of the first platform, and a second end portion mounted on the second platform. The connecting rail permits movement of the moving body from the top side of the first platform to the top side of the second platform. The top side of the first platform is formed with a slot that extends toward the first end portion of the connecting rail. The first guiding unit is mounted on the first platform, and includes a guiding rail which is mounted movably on the first platform in the slot and which is movable between a projecting position, where the guiding rail projects upwardly relative to the top side of the first platform through the slot, and a retracting position, where the guiding rail is retracted into the slot. The guiding rail blocks the second rear wheel when the driving unit drives the moving body to move on the top side of the first platform while the guiding rail is in the projecting position to result in turning of the moving body about the second rear wheel so as to align the moving body with the first end portion of the connecting rail and allow the moving body to move onto the first end portion of the connecting rail.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
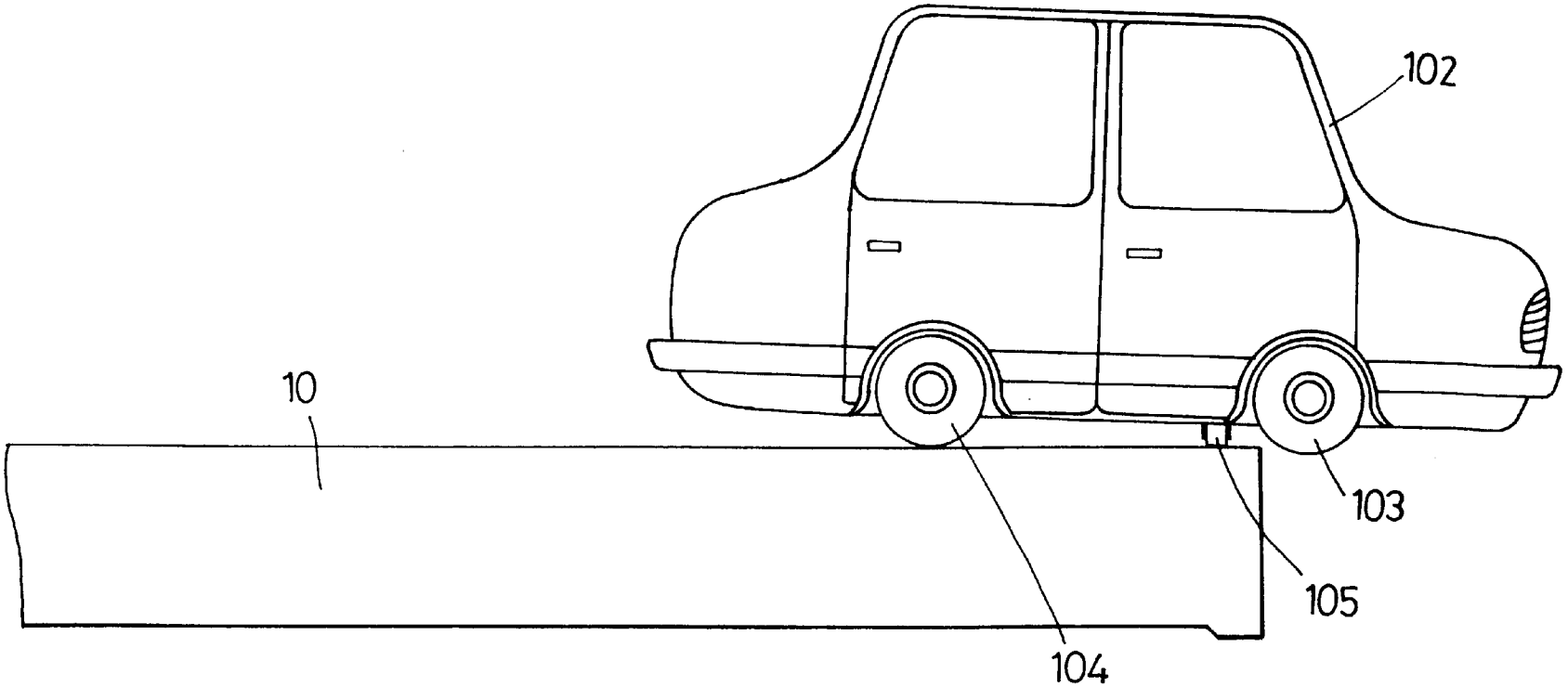
FIG. 1 PRIOR ART
FIG. 1 is a side view of a conventional toy with a moving body that is movable on a platform.
Figure 2:
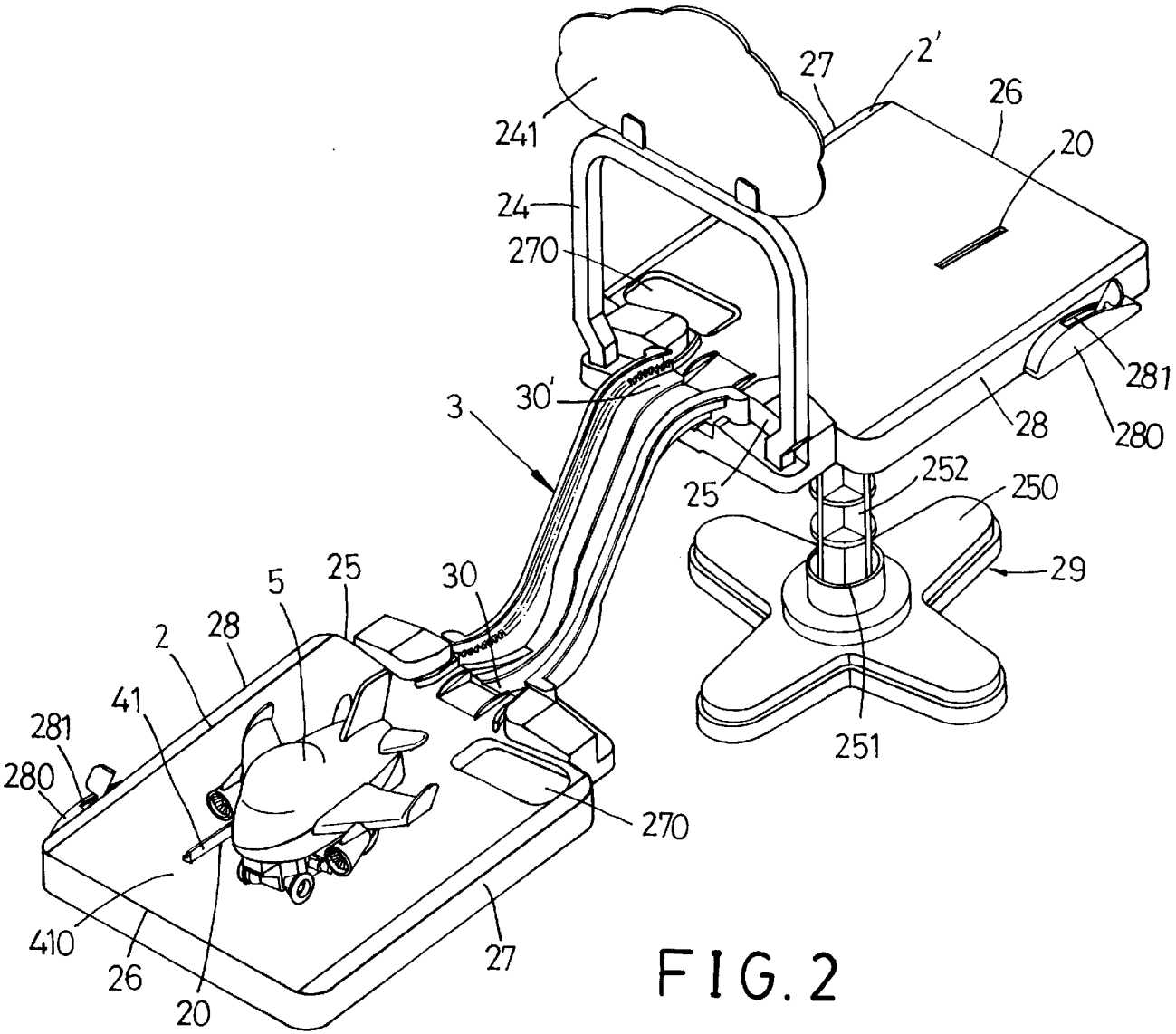
FIG. 2 is a perspective view of the preferred embodiment of a toy according to the present invention.
Figure 3:
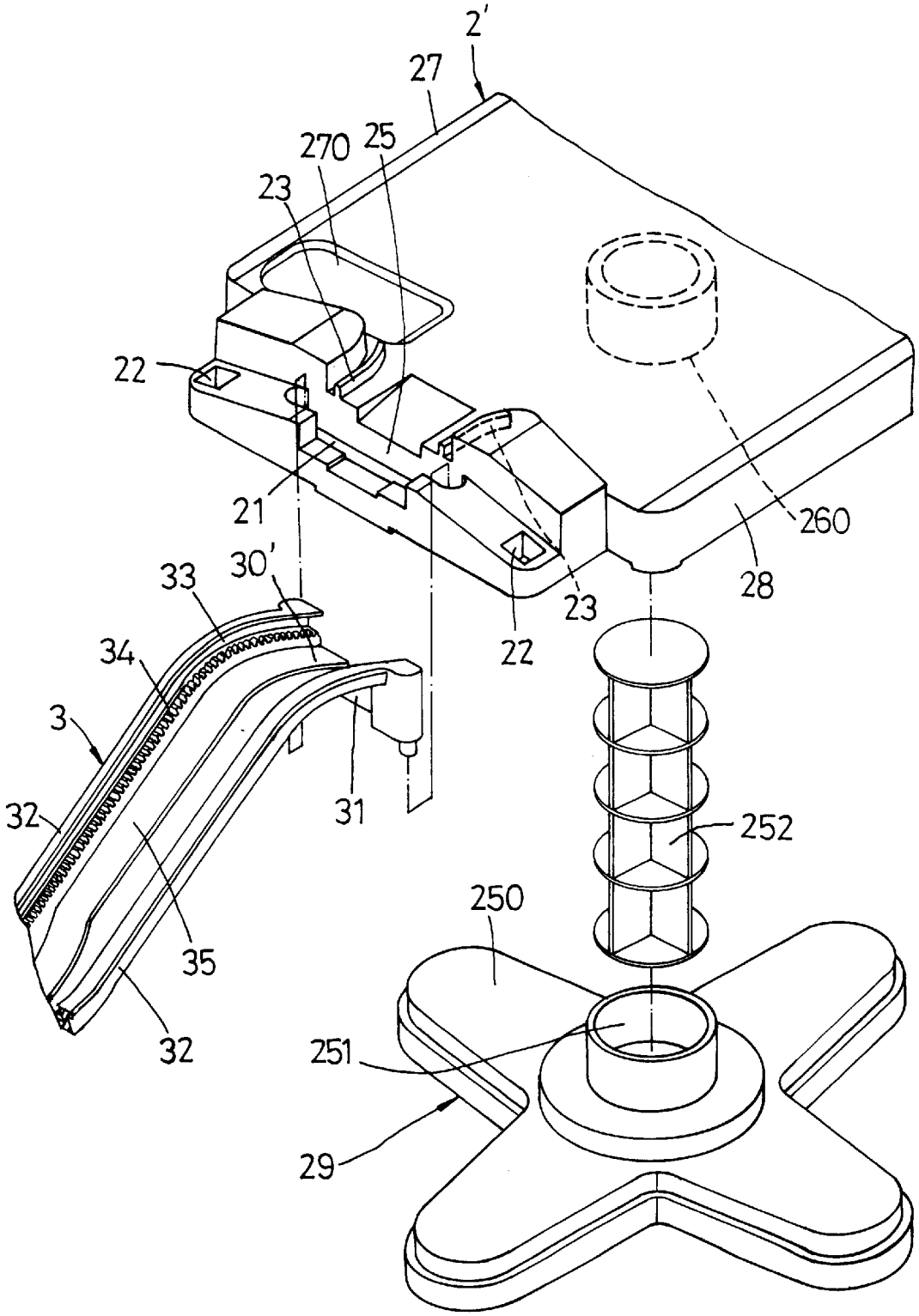
FIG. 3 is a fragmentary exploded perspective view of the toy of the preferred embodiment.

Referring to FIGS. 2 and 3, the toy of the preferred embodiment according to the present invention is shown to include a lower platform 2, an upper platform 2', a connecting rail 3 interconnecting the lower and upper platforms 2, 2', a support unit 29 for supporting the upper platform 2', and a moving body 5.

The support unit 29 supports the upper platform 2' at a level above the lower platform 2, and includes a base 250 and a prop 252. The base 250 is adapted to be supported on a horizontal surface, and has a top side formed with a circular recess 251. The prop 252 has a lower end inserted into the recess 251, and an upper end inserted into another circular recess 260 formed in a bottom side of the upper platform 2'.

The lower and upper platforms 2, 2' are similar in structure. Each of the lower and upper platforms 2, 2' is hollow, rectangular in shape, and has a generally flat top side to permit movement of the moving body 5 thereon, a proximate edge 25 proximate to the connecting rail 3, a distal edge 26 opposite to the proximate edge 25 and distal to the connecting rail 3, and opposite first and second lateral edges 28, 27 interconnecting the proximate and distal edges 25, 26. The top side of each of the lower and upper platforms 2, 2' is formed with a slot 20 that is disposed between the proximate and distal edges 25, 26 and closer to the distal edge 26. The proximate edge 25 of each of the platforms 2, 2' is formed with a spaced pair of insert holes 22, and a mounting groove 21 between the insert holes 22. The top side of each of the lower and upper platforms 2, 2' is further formed with a confronting pair of spaced-apart guiding walls 23 at the proximate edge 25. The guiding walls 23 generally extend in a direction from the proximate edge 25 toward the distal edge 26, and cooperatively define a pathway therebetween. The pathway gradually converges in a direction away from the distal edge 26. The insert holes 22 permit insertion of two opposite ends of an inverted U-shaped frame 24 thereinto for mounting removably the frame 24 on the platform 2'. The frame 24 is provided with an advertising board 241 thereon. The top side of each of the platforms 2, 2' is further formed with a rectangular indentation 270 at a corner of the second lateral edge 27 and the proximate edge 25 and adjacent to one of the guiding walls 23 that is closer to the second lateral edge 27.

The connecting rail 3 has a first end portion 30 mounted on the proximate edge 25 of the lower platform 2, and a second end portion 30' mounted on the proximate edge 25 of the upper platform 2', and inclines upwardly from the first end portion 30 to the second end portion 30' to interconnect the lower and upper platforms 2, 2'. As shown, the slot 20 formed in the lower platform 2 extends in a direction from the distal edge 26 of the lower platform 2 toward the first end portion 30 of the connecting rail 3. The slot 20 formed in the upper platform 2' extends in a direction from the distal edge 26 of the upper platform 2' toward the second end portion 30' of the connecting rail 3. Each of the first and second end portions 30, 30' is disposed adjacent to the pathway between the guiding walls 23 of a respective one of the platforms 2, 2'. Each of the first and second end portions 30, 30' is formed with a downward mounting projection 31 which engages the mounting groove 21 in a respective one of the platforms 2, 2' for mounting removably the connecting rail 3 on the platform 2, 2'. The connecting rail 3 has a generally U-shaped cross-section, and includes a pair of upright side walls 32, and a base wall 35 that interconnects bottom edges of the side walls 32. Each of the side walls 32 has an inner surface that confronts the other one of the side walls 32 and that is formed with a series of teeth 34 along the length of the connecting rail 3, and a retaining groove 33 which extends along the length of the connecting rail 3 above the teeth 34.

Figure 5:
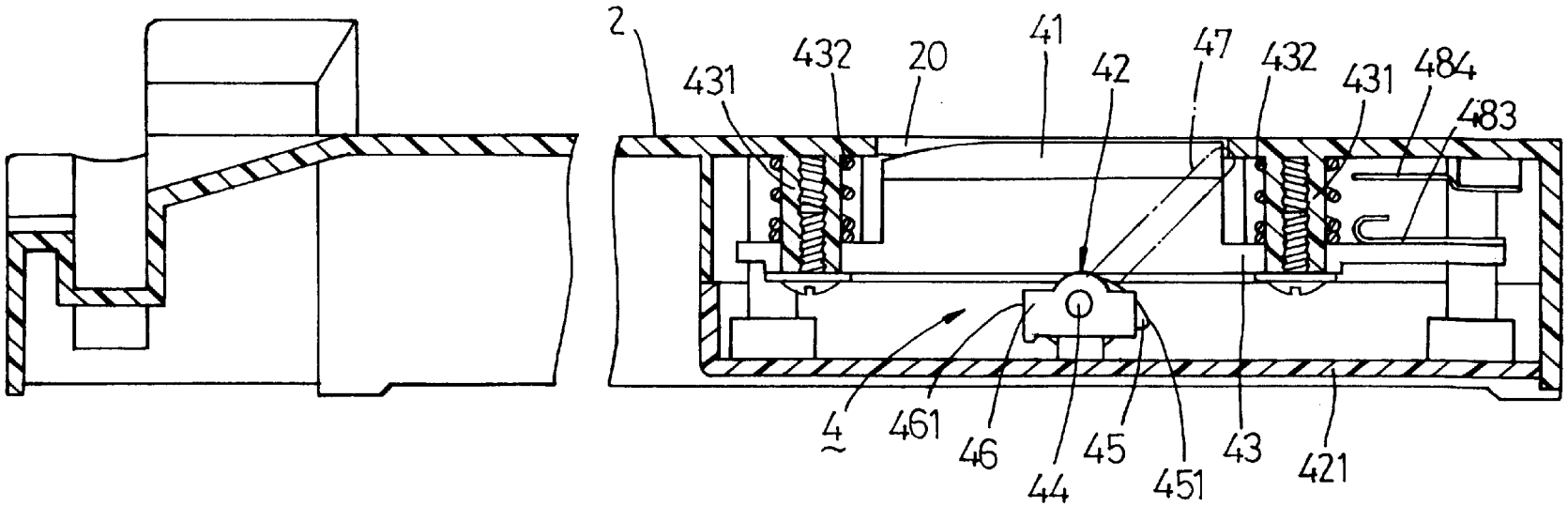
FIG. 5 is a fragmentary, partly sectional side view illustrating the platform of the toy of the preferred embodiment when a guiding rail thereof is in a retracting position.
Figure 6:
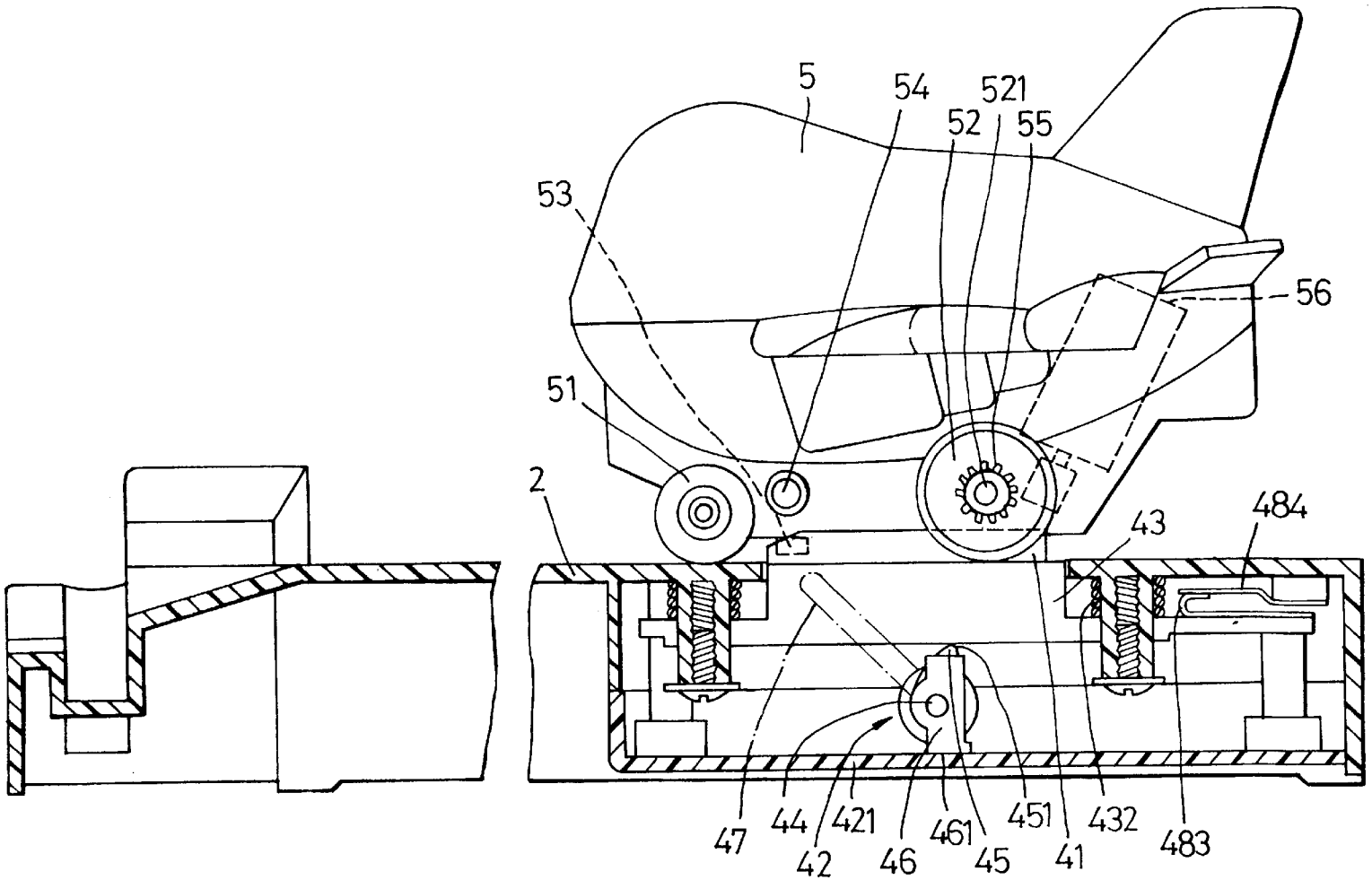
FIG. 6 is another fragmentary, partly sectional side view illustrating a moving body and the platform of the toy of the preferred embodiment when the guiding rail is in a projecting position.

Referring to FIGS. 5 and 6, each of the lower and upper platforms 2, 2' has a guiding unit 4 mounted therein. For the sake of brevity, the guiding unit 4 will now be described and illustrated in terms of the one mounted in the lower platform 2. The guiding unit 4 includes an upright guiding rail 41 and an operating unit 42 for operating the guiding rail 41. The guiding rail 41 is mounted movably on the platform 2 in the slot 20, and has a rear end that defines a clearance 410 (see FIG. 2) with the distal edge 26 of the first platform 2.

The operating unit 42 includes a movable support plate 43, and a horizontal shaft 44 disposed below the support plate 43. The support plate 43 is disposed in the platform 2 below the slot 20 for supporting the guiding rail 41 thereon. The support plate 43 is suspended within the platform 2 by means of a pair of posts 431, each of which has a biasing spring 432 sleeved thereon for biasing the support plate 43 downwardly such that the guiding rail 41 is moved to a retracting position, where the guiding rail 41 is retracted into the slot 20, as shown in FIG. 5.

The horizontal shaft 44 is mounted rotatably in the platform 2 below the support plate 43, and is rotatable about a horizontal axis. A cam member 45, an operating lever 47 and an elongated limiting plate 46 are secured on the horizontal shaft 44 for co-rotation therewith. The operating lever 47 has one end extending out of the platform 2 via a curved slit 281 (see FIG. 2) formed on top of a hollow seat 280 at the first lateral edge 28 of the platform 2. The operating lever 47 is movable by the hand of a user along the slit 281 to result in corresponding rotation of the horizontal shaft 44. The length of the curved slit 281 limits the range of movement of the operating lever 47 and thus, the range of rotation of the horizontal shaft 44. When the operating lever 47 is moved from a first end of the slit 281 to the other end of the slit 281, i.e., from the state shown in FIG. 5 to the state shown in FIG. 6, the cam member 45 is rotated together with the horizontal shaft 44 such that an end portion 451 of the cam member 45 pushes the support plate 43 upwardly so as to result in compression of the biasing springs 432. The guiding rail 41 is thus moved upwardly to a projecting position, where the guiding rail 41 projects relative to the top side of the platform 2, as shown in FIG. 6. The limiting plate 46 is rotated together with the horizontal shaft 44 such that a flat limiting edge 461 of the limiting plate 46 engages frictionally a plastic bottom wall 421 of the platform 2. With the assistance of the biasing springs 432 that apply a downward biasing force to the horizontal shaft 44 via the cam member 45, the limiting plate 46 can abut tightly against the bottom wall 421 for retaining the guiding rail 41 in the projecting position.

Figure 4:
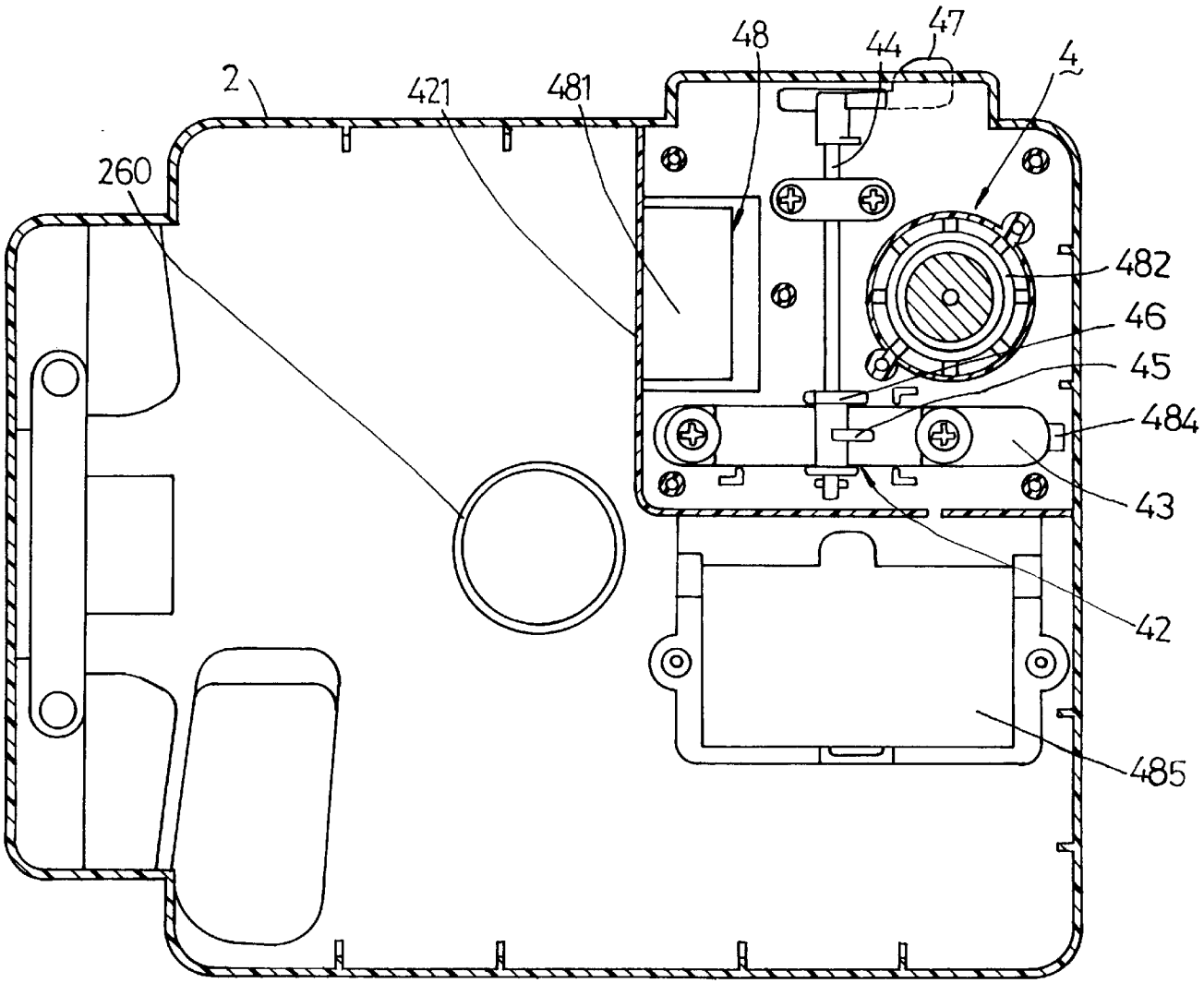
FIG. 4 is a sectional bottom view illustrating a platform of the toy of the preferred embodiment.

Referring to FIG. 4, the operating unit 42 further includes a sound effect unit 48 mounted in the platform 2. The sound effect unit 48 includes a control unit 481, a sound generator 482, first and second electrical contacts 483, 484 (see FIGS. 5 and 6), and a battery seat 485 for receiving a battery set (not shown) that provides electric power to the sound effect unit 48. As shown in FIGS. 5 and 6, the first electrical contact 483 is secured on the support plate 43 to be movable upwardly and downwardly together with the support plate 43. The second electrical contact 484 is stationary and is disposed above the first electrical contact 483. When the operating lever 47 is operated to move the guiding rail 41 to the retracted position, as shown in FIG. 5, the first electrical contact 483 is spaced-apart from the second electrical contact 484, and the sound generator 482 is deactivated. When the operating lever 47 is operated to move the guiding rail 41 to the projecting position, as shown in FIG. 6, the support plate 43 moves upwardly such that the first electrical contact 483 contacts the second electrical contact 484 to enable the sound generator 482 to generate sound that accompanies movement of the moving body 5 on the top side of the platform 2.

Figure 7:
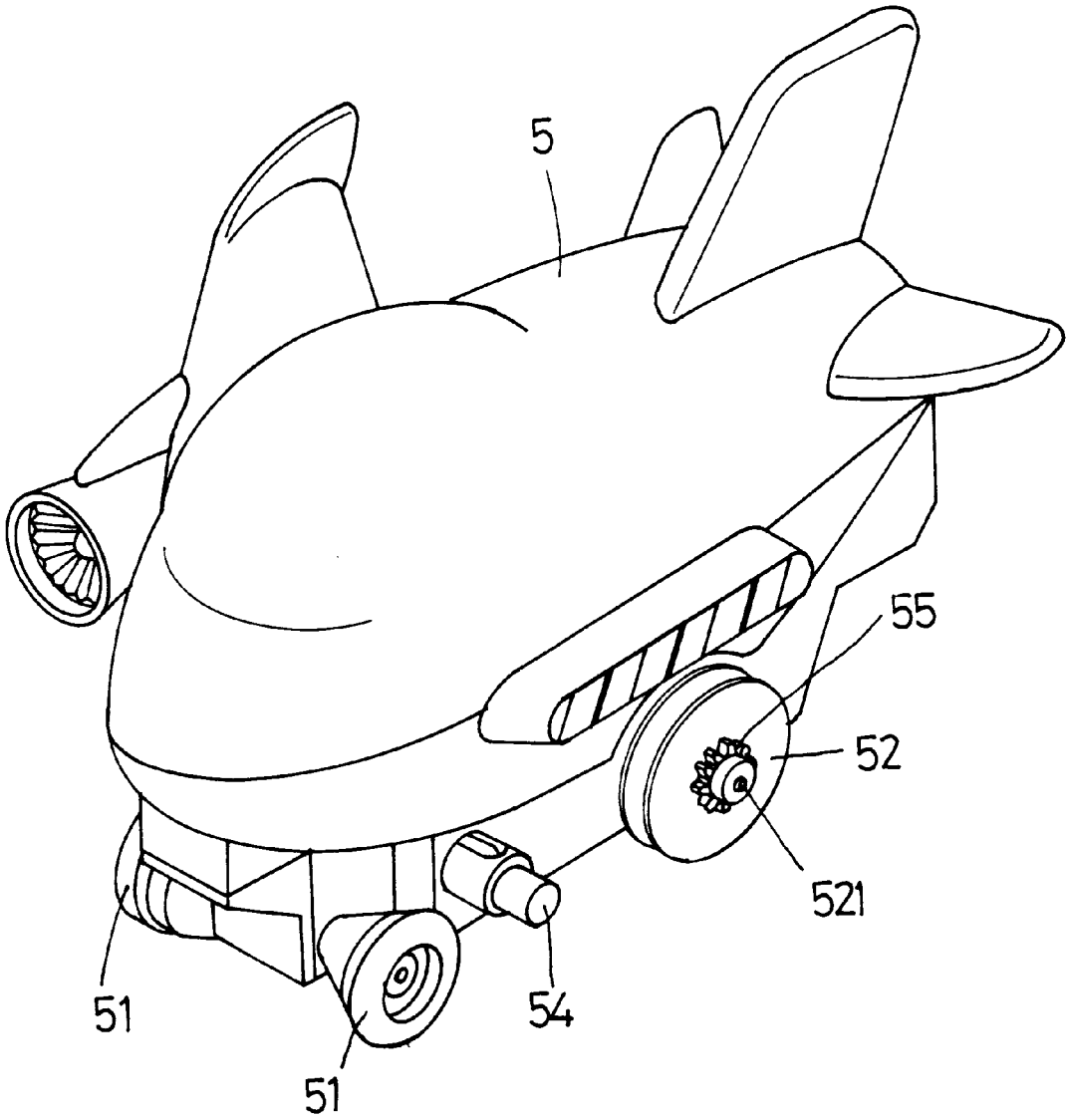
FIG. 7 is a partly sectional, perspective view illustrating the moving body of the toy of the preferred embodiment.

Referring to FIGS. 6 and 7, the moving body 5 has a front end portion provided with a spaced pair of front wheels 51 which are rotatable about a horizontal first rotary axis, a rear end portion provided with a transmission shaft 521 parallel to the first rotary axis, and a bottom side provided with a turning wheel 53 between the front and rear end portions. The turning wheel 53 is rotatable about a horizontal second rotary axis perpendicular to the first rotary axis. The transmission shaft 521 has a first rear wheel mounted securely on one end thereof, and a second rear wheel 52 mounted rotatably on the other end thereof. The two opposite ends of the transmission shaft 521 have two gears 55 that are secured respectively thereon. The distance between the pair of front wheels 51 is smaller than the distance between the pair of rear wheels. The moving body 5 is further provided with a driving unit 56 therein. The driving unit 56 is coupled to the turning wheel 53 and the transmission shaft 521 so as to drive movement of the moving body 5 on the platforms 2, 2'. The moving body 5 further has two lateral sides formed respectively with retaining projections 54.

Referring to FIGS. 2 and 6, to operate the toy of the preferred embodiment, the moving body 5 is placed on one of the platforms 2, 2', such as on the lower platform 2. When the operating lever 47 is operated to move the guiding rail 41 on the lower platform 2 to the retracting position, the guiding rail 41 does not affect movement of the moving body 5 on the platform 2 and is prevented from falling off from the platform 2 as is known in the art. When the moving body 5 moves on the platform 2 along the second lateral edge 27 in a direction from the distal edge 26 toward the proximate edge 25 to reach the indentation 270, the moving body 5 inclines such that the turning wheel 53 is in contact with the top side of the platform 2 to cause the moving body 5 to turn leftwardly away from the indentation 270 and to move toward the first lateral edge 28 before the moving body 5 reaches the proximate edge 25. The moving body 5 can thus be prevented from bumping into the adjacent guiding wall 23. When the operating lever 47 is operated to move the guiding rail 41 to the projecting position, a sound is generated by the sound generating unit 48 to accompany movement of the moving body 5. When the moving body 5 is driven by the driving unit 56 (see FIG. 6) to move along the first lateral edge 28 toward the distal edge 26, the moving body 5 turns in a direction toward the guiding rail 41 upon reaching the distal edge 26. Subsequently, when the driving unit 56 continues to drive the moving body 5 to move on the top side of the platform 2, the clearance 410, which has a size larger than the distance between the front wheels 51, permits movement of the front wheels 51 of the moving body 5 therethrough. However, the second rear wheel 52 is blocked by the guiding rail 41 to result in turning of the moving body 5 about the second rear wheel 52 so as to align the moving body 5 with the first end portion 30 of the connecting rail 3. The moving body 5 can thus be guided to move onto the connecting rail 3 via the converging pathway between the guiding walls 23.

Figure 8:
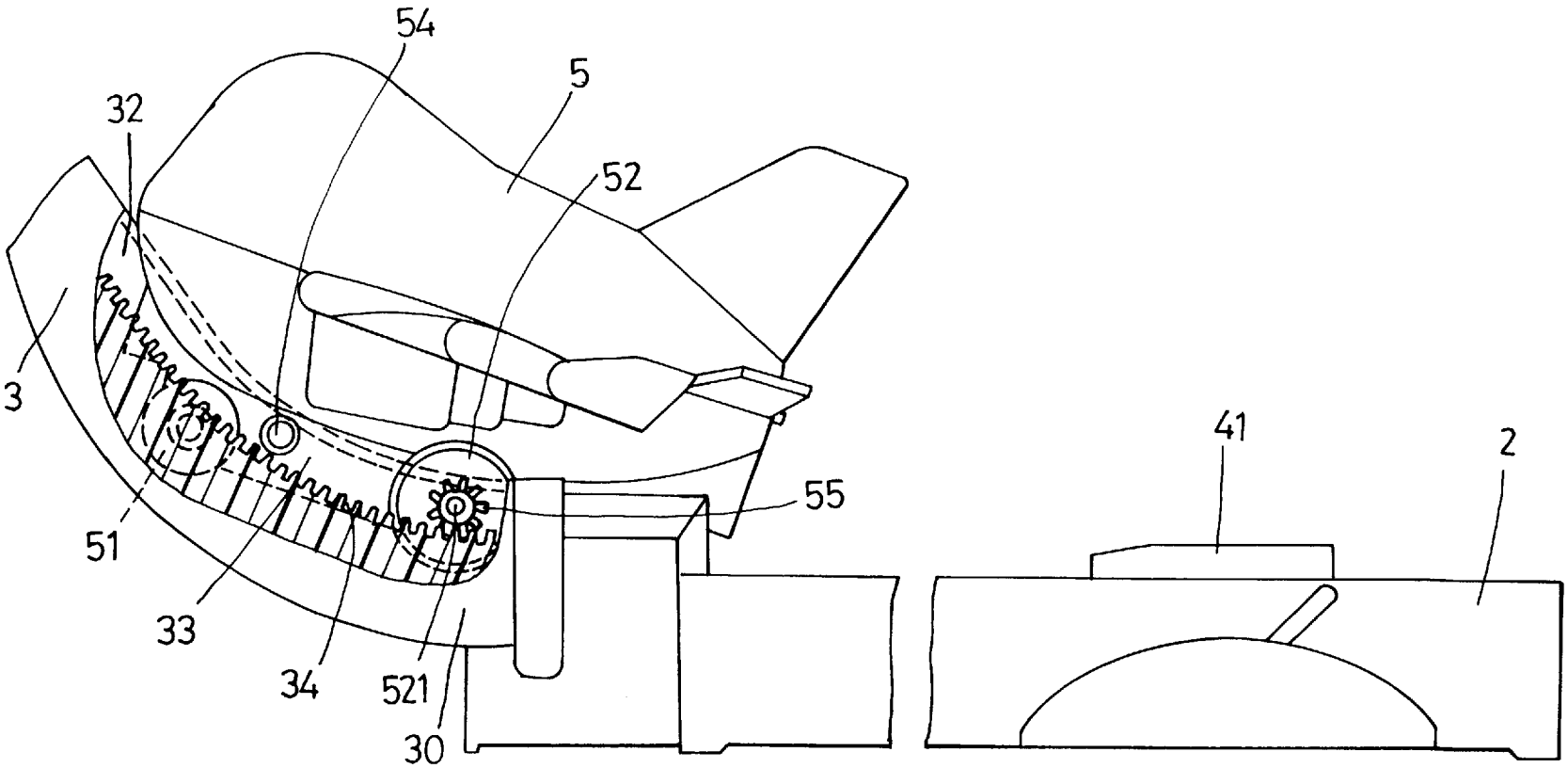
FIG. 8 is a fragmentary schematic side view of the preferred embodiment, illustrating how the moving body moves along a connecting rail.

Referring to FIGS. 2 and 8, when the moving body 5 is driven to move onto the first end portion 30 of the connecting rail 3, the retaining projections 54 of the moving body 5 extend into the retaining grooves 33 formed in the side walls 32 of the connecting rail 3, and the gears 55 mesh with the teeth 34 on the side walls 32. By virtue of the driving force provided by the driving unit 56 (see FIG. 6) and transmitted by the transmission shaft 521, the moving body 5 can move upwardly along the connecting rail 3 from the first end portion 30 via the second end portion 30' to the upper platform 2'. The moving body 5 then moves on the top side of the upper platform 2' in a manner similar to its movement on the lower platform 2 as long as the driving unit 56 continues to operate. Likewise, when the guiding rail 41 of the guiding unit 4 mounted on the upper platform 2' is moved to the projecting position, the moving body 5 can be guided once again to move onto the second end portion 30' of the connecting rail 3 and back to the lower platform 2. Therefore, the moving body 5 is capable of moving reciprocatingly between the lower and upper platforms 2, 2' when the guiding rails 41 are in the projecting position while the driving unit 56 operates. The engagement between the retaining grooves 33 in the side walls 32 of the connecting rail 3 and the retaining projections 54 of the moving body 5 prevent overturning of the moving body 5 whenever the moving body 5 moves upwardly or downwardly along the connecting rail 3. This is especially helpful when the connecting rail 3 is relatively steep.

With this invention thus explained, it is apparent that numerous modifications and variations can be made without departing from the scope and spirit of this invention. It is therefore intended that this invention be limited only as indicated in the appended claims.

I claim:

1. A toy comprising:

a hollow first platform having a top side, a proximate edge, a distal edge, and first and second lateral edges interconnecting said proximate and distal edges;

a moving body having a front end portion provided with a front wheel unit which is rotatable about a horizontal first rotary axis, a rear end portion provided with a horizontal transmission shaft parallel to said first rotary axis, and a bottom side provided with a turning wheel between said front and rear end portions, said transmission shaft having two opposite ends, said moving body further having a first rear wheel mounted securely on one of said ends of said transmission shaft, and a second rear wheel mounted rotatably on the other one of said ends of said transmission shaft, said turning wheel being rotatable about a horizontal second rotary axis perpendicular to said first rotary axis, said turning wheel having a bottom portion which is disposed higher than bottom portions of said front wheel unit and said rear wheels, said moving body being provided with a driving unit that is coupled to said turning wheel and said transmission shaft to drive movement of said moving body on said top side of said first platform, said turning wheel preventing said moving body from falling off said first platform when said driving unit drives movement of said moving body on said top side of said first platform;

a second platform spaced apart from said first platform and having a top side;

a connecting rail having a first end portion mounted on said proximate edge of said first platform and a second end portion mounted on said second platform, said connecting rail permitting movement of said moving body from said top side of said first platform to said top side of said second platform, said top side of said first platform being formed with a slot that extends toward said first end portion of said connecting rail;

a first guiding unit mounted on said first platform and including a guiding rail which is mounted movably on said first platform in said slot and which is movable between a projecting position, where said guiding rail projects upwardly relative to said top side of said first platform through said slot, and a retracting position, where said guiding rail is retracted into said slot, said guiding rail blocking said second rear wheel when said driving unit drives said moving body to move on said top side of said first platform while said guiding rail is in the projecting position to result in turning of said moving body about said second rear wheel so as to align said moving body with said first end portion of said connecting rail and allow said moving body to move onto said first end portion of said connecting rail, and wherein said slot is disposed between said proximate and distal ends and extends in a direction from said distal edge toward said first end portion of said connecting rail said guiding rail having a rear end that defines a clearance with said distal edge of said first platform, said clearance having a size sufficient to permit movement of said front wheel unit and said turning wheel therethrough and to cause said guiding rail to block said second rear wheel when said driving unit drives said moving body to move on said top side of said first platform along said distal edge from said first lateral edge toward said second lateral edge while said guiding rail is in the projecting position.

2. The toy according to claim 1, wherein said front wheel unit includes a spaced pair of front wheels which are spaced apart by a distance that is smaller than said clearance.

3. The toy according to claim 1, wherein said first guiding unit further includes an operating unit mounted in said first platform and associated operably with said guiding rail to move said guiding rail between the projecting and retracting positions.

4. The toy according to claim 3, wherein said operating unit includes:

a movable support plate mounted in said first platform below said slot for supporting said guiding rail thereon;

a biasing member disposed in said first platform for biasing said support plate downwardly so as to move said guiding rail to the retracting position;

a horizontal shaft mounted rotatably in said first platform and rotatable about a horizontal axis;

a cam member mounted securely on said horizontal shaft and disposed below said support plate; and an operating lever mounted securely on said horizontal shaft and extending out of said first platform, said operating lever being operable to rotate said horizontal shaft and move said cam member together with said horizontal shaft so as to push said support plate upwardly against biasing force of said biasing member to move said guiding rail to the projecting position.

5. The toy according to claim 4, wherein said operating unit further includes retaining means for retaining said guiding rail in the projecting position.

6. The toy according to claim 5, wherein said first platform has a bottom wall disposed below said operating unit, said retaining means including a limiting plate mounted securely on said horizontal shaft, said limiting plate having a limiting edge portion which engages frictionally said bottom wall when said operating lever is operated to move said guiding rail to the projecting position so as to retain said guiding rail in the projecting position.

7. The toy according to claim 1, wherein said connecting rail has a generally U-shaped cross-section and includes a pair of upright side walls and a base wall that interconnects said side walls, said moving body being movable along said base wall and between said side walls, each of said side walls having an inner surface which confronts the other one of said side walls and which is formed with a retaining groove that extends along length of said connecting rail, said moving body having two lateral sides formed respectively with retaining protrusions that extend slidably and respectively into said retaining grooves when said driving unit drives said moving body to move along said connecting rail.

8. The toy according to claim 7, wherein said top side of said second platform is disposed higher than said top side of said first platform, said connecting rail inclining upwardly from said first end portion to said second end portion.

9. The toy according to claim 8, wherein said inner surface of each of said side walls is formed with a series of teeth along the length of said connecting rail, said moving body further having a pair of gears that are secured on said opposite ends of said transmission shaft, respectively, and that mesh respectively with said teeth on said side walls of said connecting rail such that said moving body is movable upwardly along said connecting rail from said first end portion to said second end portion when said driving unit operates.

10. The toy according to claim 8, further comprising a support unit for supporting said second platform at a level above said first platform, said support unit including a base which is adapted to be supported on a horizontal surface and which has a top side formed with a first recess, and an upright prop having a lower end inserted into said recess and an upper end, said second platform having a bottom side formed with a second recess for receiving said upper end of said prop.

11. The toy according to claim 1, wherein said first platform is formed with a confronting pair of spaced-apart guiding walls adjacent to said proximate edge of said first platform, said guiding walls cooperatively defining a pathway therebetween for movement of said moving body onto said connecting rail, said pathway gradually converging in a direction toward said first end portion of said connecting rail for guiding movement of said moving body into said connecting rail.

12. The toy according to claim 4, wherein said top side of said first platform is formed with a rectangular indentation at a corner of said proximate edge and said second lateral edge and adjacent to one of said guiding walls, said indentation causing said moving body to turn before said moving body reaches said proximate edge when said driving unit drives said moving body to move on said top side of said first platform along said second lateral edge in a direction toward said proximate edge.

13. The toy according to claim 1, wherein said first end portion of said connecting rail is formed with a mounting projection, said proximate edge of said first platform being formed with a mounting groove for engaging releasably said mounting projection of said connecting rail.

14. The toy according to claim 1, wherein said second platform has a proximate edge mounted on said second end portion of said connecting rail, a distal edge opposite to said proximate edge, and first and second lateral edges interconnecting said proximate and distal edges, said toy further comprising a second guiding unit mounted on said second platform and selectively operable to cause said moving body to turn in a direction toward said connecting rail when said driving unit drives said moving body to move on said top side of said second platform so as to guide movement of said moving body onto said second end portion of said connecting rail.

* * * * *